US009510983B2

(12) United States Patent
Smith

(10) Patent No.: US 9,510,983 B2
(45) Date of Patent: Dec. 6, 2016

(54) FUNCTIONAL BASKET ASSEMBLIES FOR A WHEELCHAIR

(71) Applicant: Gwendolyn Sue Smith, Brookhaven, MS (US)

(72) Inventor: Gwendolyn Sue Smith, Brookhaven, MS (US)

(73) Assignee: LAGWENBRE DESIGNER CORPORATION, Brookhaven, MS (US)

( * ) Notice: Subject to any disclaimer, the term of this patent is extended or adjusted under 35 U.S.C. 154(b) by 0 days.

(21) Appl. No.: 14/703,393

(22) Filed: May 4, 2015

(65) Prior Publication Data

US 2016/0324704 A1 Nov. 10, 2016

(51) Int. Cl.
*A61G 5/00* (2006.01)
*A61G 5/10* (2006.01)

(52) U.S. Cl.
CPC ..... *A61G 5/10* (2013.01)

(58) Field of Classification Search
CPC ..... A61G 5/10
USPC ..... 280/47.38, 304.1
See application file for complete search history.

(56) References Cited

U.S. PATENT DOCUMENTS 3,371,842 A * 3/1968 Hechtmann ..... B65D 5/0005 229/101
3,581,976 A * 6/1971 Burgess ..... B65D 5/6652 229/148
4,158,428 A * 6/1979 Bates ..... A61G 5/10 224/275
4,257,545 A * 3/1981 Rhyan ..... A61G 5/10 224/407
4,305,601 A * 12/1981 Berge ..... A61G 5/10 280/304.1
4,339,063 A * 7/1982 Trubiano ..... A61G 5/10 224/407
4,403,786 A * 9/1983 Ulics ..... A61G 5/10 224/407
4,449,750 A * 5/1984 Pultman ..... A61G 5/10 108/44
4,484,755 A * 11/1984 Houston ..... A61G 5/10 280/304.1
4,526,419 A * 7/1985 Bowman ..... A47C 7/68 224/407
4,580,803 A * 4/1986 Davis ..... A61G 5/10 224/407

(Continued)

*Primary Examiner* — J. Allen Shriver, II
*Assistant Examiner* — Brian Cassidy
(74) *Attorney, Agent, or Firm* — King & Spalding LLP

(57) ABSTRACT

A basket assembly for a wheelchair is described herein. The basket assembly can include a basket and a mounting assembly coupled to the basket. The basket can include a base panel having at least one bracket coupling feature, a rear panel and a front panel coupled to the base panel, and a left side panel and a right side panel coupled to the base panel, the rear panel, and the front panel. The mounting assembly can include a main portion having a first end, a second end, and at least one basket coupling feature disposed between the first end and the second end. The mounting assembly can also include an elbow coupled to the first end of the main portion, and a wheelchair coupling feature coupled to the elbow, where the wheelchair coupling feature can be configured to couple to a portion of a wheelchair.

20 Claims, 9 Drawing Sheets

(56) References Cited

U.S. PATENT DOCUMENTS 4,659,099 A * 4/1987 Malone ..... A61G 5/10 108/44
4,795,182 A * 1/1989 Dyess ..... A61G 5/10 188/2 F
4,815,688 A * 3/1989 Wood ..... A61G 5/10 248/118
4,830,388 A * 5/1989 Wang ..... A61G 5/003 280/202
5,026,114 A * 6/1991 Miller ..... A47C 7/68 108/49
5,139,309 A * 8/1992 Kornreich ..... A47C 7/70 297/145
5,294,027 A * 3/1994 Plastina ..... A61G 5/10 220/6
5,356,059 A * 10/1994 Yanez ..... A61G 5/10 224/407
5,480,079 A * 1/1996 Douglass ..... A61G 5/10 135/67
5,515,987 A * 5/1996 Jacques ..... B65D 11/1833 220/6
5,779,118 A * 7/1998 Douglass ..... A61G 5/10 224/407
5,813,582 A * 9/1998 Wright ..... A61G 5/10 224/407
5,842,745 A * 12/1998 Kelly ..... A61G 5/10 297/153
6,209,611 B1 * 4/2001 Johnson ..... A47C 7/66 135/88.03
6,217,052 B1 * 4/2001 Slagerman ..... A61G 5/10 280/149.2
6,401,995 B1 * 6/2002 Yuille ..... B60R 9/00 220/483
7,229,001 B2 * 6/2007 Wang ..... B65D 5/326 220/4.29
7,500,689 B2 * 3/2009 Pasternak ..... A61G 5/10 280/250.1
7,726,327 B2 * 6/2010 Battiston ..... A61H 3/04 135/66
7,871,088 B2 * 1/2011 Silva ..... A61G 5/10 135/66
7,967,174 B2 * 6/2011 Lauber ..... A61G 5/10 224/407
8,167,157 B2 * 5/2012 Shalomoff ..... B65D 11/1833 220/4.08
8,181,806 B2 * 5/2012 Hidalgo Vargas . B65D 11/1833 220/4.08
8,292,314 B1 * 10/2012 Schaal ..... A61G 5/10 280/250.1
8,870,209 B2 * 10/2014 Conrad ..... B60D 1/167 280/250.1
9,114,844 B2 * 8/2015 Walter ..... B62K 13/04
2006/0032417 A1 * 2/2006 Goschy ..... A47C 7/68 108/147
2006/0237455 A1 * 10/2006 Vargas ..... B65D 7/24 220/4.34
2006/0244238 A1 * 11/2006 Lewis ..... A61G 5/10 280/304.1
2008/0041282 A1 * 2/2008 Goschy ..... A61G 5/10 108/141

* cited by examiner

FUNCTIONAL BASKET ASSEMBLIES FOR A WHEELCHAIR

TECHNICAL FIELD

The present disclosure relates generally to wheelchair accessories, and more particularly to systems, methods, and devices for functional basket assemblies for a wheelchair.

BACKGROUND

Many people use a wheelchair, whether on a temporary or permanent basis. There are many types of wheelchairs available for a person to use. A number of these wheelchairs are fairly basic in terms of functionality. At times a user of such a wheelchair has objects to carry. In some cases, a user performs tasks (e.g., writing, working on a laptop computer, eating) while sitting in a wheelchair.

SUMMARY

In general, in one aspect, the disclosure relates to a basket assembly for a wheelchair. The basket assembly can include a basket and a mounting assembly coupled to the basket. The basket of the basket assembly can include a base panel having at least one bracket coupling feature, and a rear panel coupled to the base panel. The basket of the basket assembly can also include a front panel coupled to the base panel, and a left side panel coupled to the base panel, the rear panel, and the front panel. The basket of the basket assembly can further include a right side panel coupled to the base panel, the rear panel, and the front panel. The mounting assembly of the basket assembly can include a main portion having a first end, a second end, and at least one basket coupling feature disposed between the first end and the second end. The mounting assembly of the basket assembly can also include an elbow coupled to the first end of the main portion, and a wheelchair coupling feature coupled to the elbow. The wheelchair coupling feature can be configured to couple to a portion of a wheelchair, and the main portion can rotate relative to the wheelchair coupling feature using the elbow.

In another aspect, the disclosure can generally relate to a mounting assembly for a wheelchair. The mounting assembly can include a main portion having a first end, a second end, and at least one basket coupling feature disposed between the first end and the second end, where the at least one basket coupling feature is configured to couple to a basket. The mounting assembly can also include a first elbow coupled to the first end of the main portion, and a first wheelchair coupling feature coupled to the first elbow, where the first wheelchair coupling feature is configured to couple to the wheelchair. The main portion can rotate relative to the first wheelchair coupling feature using the first elbow.

In yet another aspect, the disclosure can generally relate to a wheelchair that includes a frame and a basket assembly coupled to the frame. The basket assembly of the wheelchair can include a basket and a mounting assembly coupled to the basket. The basket of the basket assembly of the wheelchair can include a base panel having at least one bracket coupling feature, and a rear panel coupled to the base panel. The basket of the basket assembly of the wheelchair can also include a front panel coupled to the base panel, and a left side panel coupled to the base panel, the rear panel, and the front panel. The basket of the basket assembly of the wheelchair can further include a right side panel coupled to the base panel, the rear panel, and the front panel. The mounting assembly of the basket assembly of the wheelchair can include a main portion having a first end, a second end, and at least one basket coupling feature disposed between the first end and the second end. The mounting assembly of the basket assembly of the wheelchair can also include an elbow coupled to the first end of the main portion, and a wheelchair coupling feature coupled to the elbow and to the frame of the wheelchair. The main portion can rotate relative to the wheelchair coupling feature using the elbow.

These and other aspects, objects, features, and embodiments will be apparent from the following description and the appended claims.

BRIEF DESCRIPTION OF THE DRAWINGS

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION

Figure 1A:
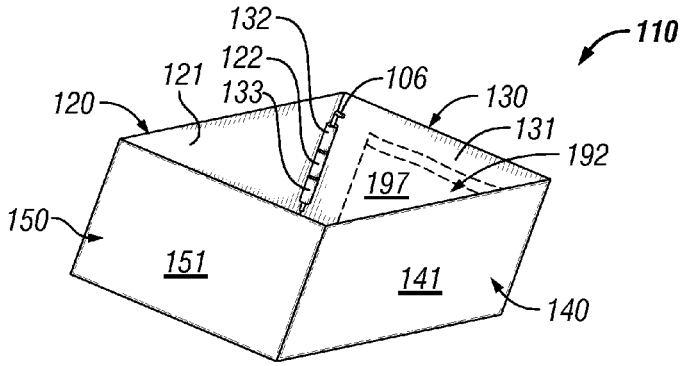
FIGS. 1A-1D show various views of a functional basket for a wheelchair in accordance with certain example embodiments.

In general, example embodiments provide systems, methods, and devices for functional basket assemblies for a wheelchair. Example functional basket assemblies for a wheelchair provide a number of benefits. Such benefits can include, but are not limited to, operation by a user without tools (e.g., only by hand), multiple uses of the example basket, flexibility of repositioning the example basket, and flexibility of reconfiguring the example basket.

The example embodiments discussed herein can be directed to any type of wheelchair (e.g., manually operated wheelchair, automated wheelchair, battery operated wheelchair). In some cases, example embodiments can be used with other types of chairs or seats that are not wheelchairs. A user may be any person that interacts with example functional basket assemblies for a wheelchair. Examples of a user may include, but are not limited to, an engineer, an electrician, a caregiver, a nurse, a physical therapist, a disabled (e.g., permanent, temporary) person, an elderly person, a consultant, a contractor, and a manufacturer's representative.

The functional basket assemblies for a wheelchair (or components thereof) described herein can be made of one or more of a number of suitable materials to allow the example functional basket assemblies to meet certain standards and/or regulations while also maintaining durability in light of the one or more conditions under which the functional basket assemblies can be exposed. Examples of such materials can include, but are not limited to, aluminum, stainless steel, fiberglass, glass, plastic, ceramic, and rubber.

Example functional basket assemblies for a wheelchair, or portions thereof, described herein can be made from a single piece (as from a mold, injection mold, die cast, or extrusion process). In addition, or in the alternative, example functional basket assemblies for a wheelchair, or portions thereof, can be made from multiple pieces that are mechanically coupled to each other. In such a case, the multiple pieces can be mechanically coupled to each other using one or more of a number of coupling methods, including but not limited to hinge portions, epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, mounting, fastening, securing, or other similar terms. Such terms are merely meant to distinguish various elements and/or features within a component or device and are not meant to limit the capability or function of that particular element and/or feature. For example, a feature described as a "coupling feature" can couple, mount, secure, fasten, and/or perform other functions aside from merely coupling.

A coupling feature (including a complementary coupling feature) as described herein can allow one or more components and/or portions of an example functional basket assembly for a wheelchair (e.g., a side panel, a base panel, a wheelchair coupling feature) to become mechanically coupled, directly or indirectly, to another portion of the functional basket assembly or to a wheelchair. A coupling feature can include, but is not limited to, a portion of a hinge, an aperture, a recessed area, a protrusion, a clamp, a slot, a spring clip, a tab, a detent, and mating threads. One portion of an example basket assembly can be coupled to a component of the basket assembly by the direct use of one or more coupling features.

In addition, or in the alternative, a component of an example functional basket assembly for a wheelchair can be coupled to another component of the functional basket assembly or a wheelchair using one or more independent devices that interact with one or more coupling features disposed on a component of the functional basket assembly. Examples of such devices can include, but are not limited to, a pin, a hinge, a fastening device (e.g., a bolt, a screw, a rivet), and a spring. One coupling feature described herein can be the same as, or different than, one or more other coupling features described herein. A complementary coupling feature as described herein can be a coupling feature that mechanically couples, directly or indirectly, with another coupling feature.

Further, if a component of a figure is described but not expressly shown or labeled in that figure, the label used for a corresponding component in another figure can be inferred to that component. Conversely, if a component in a figure is labeled but not described, the description for such component can be substantially the same as the description for the corresponding component in another figure. The numbering scheme for the various components in the figures herein is such that each component is a three digit number and corresponding components in other figures have the identical last two digits.

In the foregoing figures showing example embodiments of functional basket assemblies for a wheelchair, one or more of the components shown may be omitted, repeated, and/or substituted. Accordingly, example embodiments of functional basket assemblies for a wheelchair should not be considered limited to the specific arrangements of components shown in any of the figures. For example, features shown in one or more figures or described with respect to one embodiment can be applied to another embodiment associated with a different figure or description.

In certain example embodiments, functional basket assemblies for a wheelchair are subject to meeting certain standards and/or requirements. For example, the Americans With Disabilities Act (ADA) sets forth standards as to wheelchairs in the United States of America. Use of example embodiments described herein meet (and/or allow a corresponding device to meet) such standards when required. In some (e.g., travel, hospitals) applications, additional standards particular to that application may be met by the wheelchairs to which example functional basket assemblies are coupled. For example, the example functional basket assemblies, when coupled to enclosure wheelchair, can allow the wheelchair to meet ADA standards for sanitation, durability, safety, and accessibility.

Example embodiments of functional basket assemblies for a wheelchair will be described more fully hereinafter with reference to the accompanying drawings, in which example embodiments of functional basket assemblies for a wheelchair are shown. Functional basket assemblies for a wheelchair may, however, be embodied in many different forms and should not be construed as limited to the example embodiments set forth herein. Rather, these example embodiments are provided so that this disclosure will be thorough and complete, and will fully convey the scope of functional basket assemblies for a wheelchair to those of ordinary skill in the art. Like, but not necessarily the same, elements (also sometimes called components) in the various figures are denoted by like reference numerals for consistency.

Terms such as "first", "second", "top", "bottom", "base", "side", "width", "length", "front", "rear", "left", and "right" are used merely to distinguish one component (or part of a component or state of a component) from another. Such terms are not meant to denote a preference or a particular orientation, and are not meant to limit embodiments of functional basket assemblies for a wheelchair. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Figure 1C:
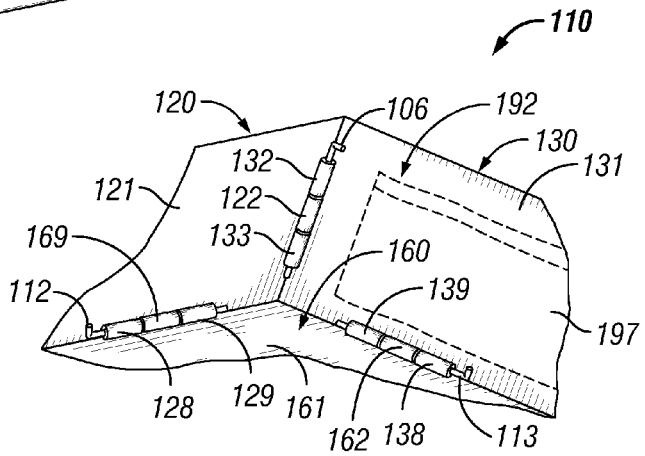
Figure 1B:
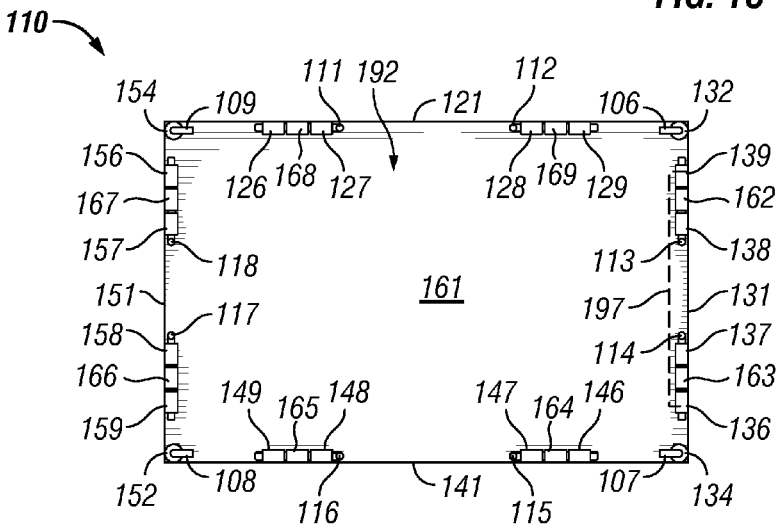
Figure 1D:
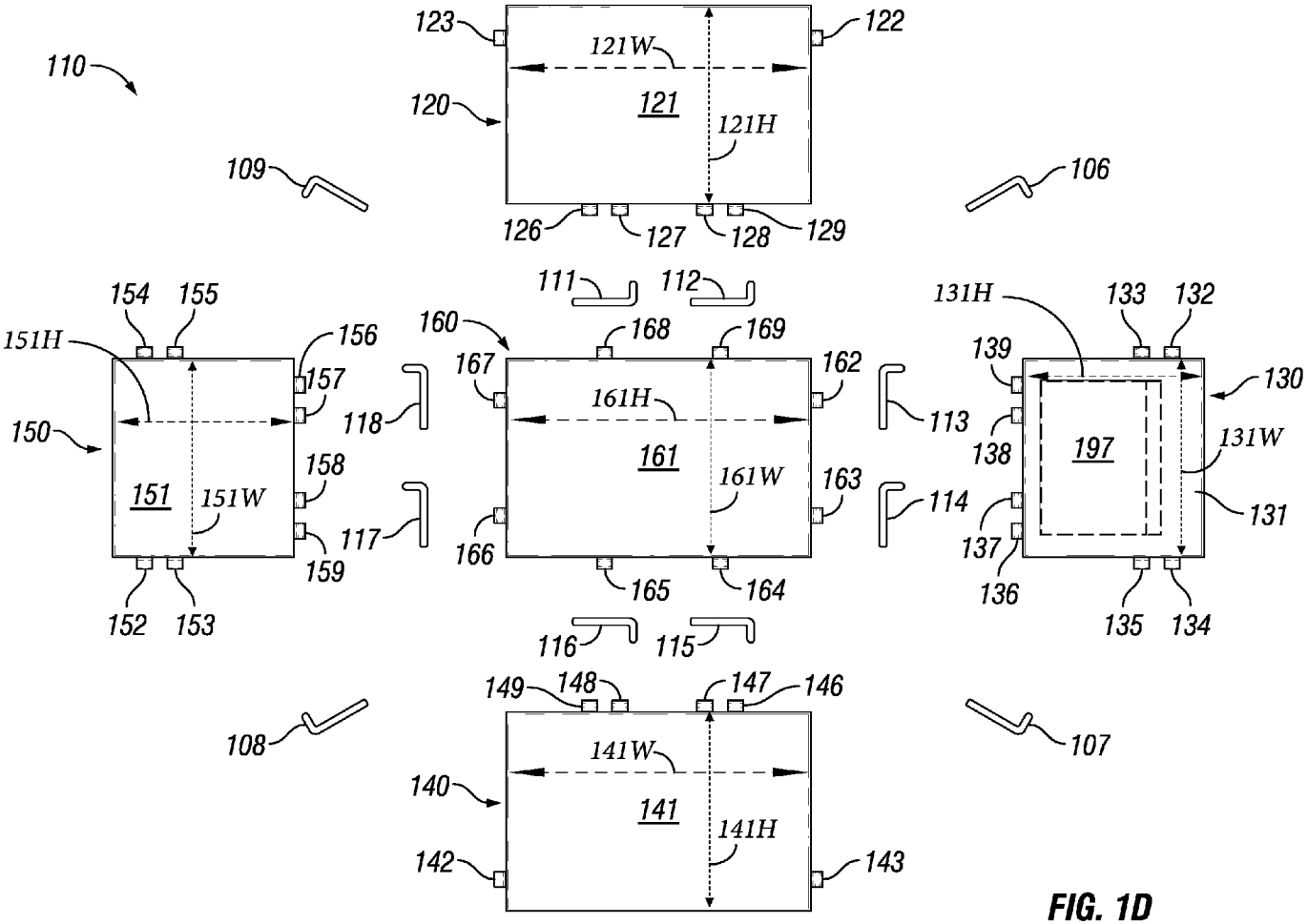

FIGS. 1A-1D show various views of a basket 110 in accordance with certain example embodiments. Specifically, FIG. 1A shows a perspective view of the basket 110. FIG. 1B shows a top view of the basket 110. FIG. 1C shows a detailed view of a portion of the basket 110. FIG. 1D shows an exploded view of the basket 110. Referring to FIGS. 1A-1D. the basket 110 can include a base panel 160, a front panel 150, a rear panel 130, a left panel 120, and a right panel 140. The base panel 160, a front panel 150, a rear panel 130, a left panel 120, and a right panel 140, when coupled to each other, form a cavity 192 into which one or more objects (e.g., books, papers, food, blanket) can be placed. As defined herein a panel is a section or portion of the basket 110. A panel can be rigid, flexible, or both rigid and flexible. For example, the outer perimeter of the panel body 121 can be rigid (e.g., have a metal frame), while the remainder of the panel body 121 can be flexible (e.g., a fabric that surrounds the outer frame and also fills the space formed between the metal frame). A panel can be opaque or, to some degree, transparent (e.g., a mesh).

The left panel 120 can have a panel body 121 that has a width 121W (also sometimes called a length herein), a height 121H, and a thickness. In certain example embodiments, the width 121W of the panel body 121 of the left panel 120 is substantially the same as a height 161H of the panel body 161 of the base panel 160, described below. In addition, or in the alternative, the height 121H of the panel body 121 of the left panel 120 can be no greater than the width 161W of the panel body 161 of the base panel 160.

The left panel 120 can also include one or more of a number of coupling features disposed on the panel body 121. For example, as shown in FIG. 1D, disposed along the bottom of the panel body 121 are coupling feature 126, coupling feature 127, coupling feature 128, and coupling feature 129. Coupling feature 126, coupling feature 127, coupling feature 128, and coupling feature 129 are configured to couple to a complementary coupling feature of another component of the basket 110. For example, in this case, coupling feature 126 and coupling feature 127 are configured to couple to coupling feature 168 of the base panel 160, as described below. As another example, in this case, coupling feature 128 and coupling feature 129 are configured to couple to coupling feature 169 of the base panel 160, as described below.

As discussed above, each coupling feature of the left panel 120 can take one of a number of forms. In this case, coupling feature 126 and coupling feature 127 are part of a hinge, and coupling feature 128 and coupling feature 129 are part of another hinge. In certain example embodiments, the coupling features (in this case, coupling feature 126, coupling feature 127, coupling feature 128, and coupling feature 129) disposed along the bottom of the panel body 121 allow the left panel 120 to be movably or removably coupled to the base panel 160. Each of the coupling features (in this case, coupling feature 126, coupling feature 127, coupling feature 128, and coupling feature 129) disposed along the bottom of the panel body 121 of the left panel 120 can be disposed on an inner surface, an outer surface, or extend radially away from the bottom of the panel body 121. In this example, coupling feature 126, coupling feature 127, coupling feature 128, and coupling feature 129 are disposed on the inner surface of the panel body 121.

The left panel 120 can also have one or more other coupling features. For example, as shown in FIG. 1D, disposed along the left side of the panel body 121 is coupling feature 123, and coupling feature 122 can be disposed along the right side of the panel body 121. Coupling feature 122 and coupling feature 123 can be configured to couple to complementary coupling features of another component of the basket 110. For example, in this case, coupling feature 122 is configured to couple to coupling feature 132 and coupling feature 133 of the rear panel 130, as described below. As another example, in this case, coupling feature 123 is configured to couple to coupling feature 154 and coupling feature 155 of the front panel 150, as described below. In this case, coupling feature 122 and coupling feature 123 are each part of a hinge. Each of the coupling features (in this case, coupling feature 122 and coupling feature 123) disposed along a side of the panel body 121 of the left panel 120 can be disposed on an inner surface, an outer surface, or extend radially away from the side of the panel body 121. In this example, coupling feature 122 and coupling feature 123 are disposed on the inner surface of the panel body 121.

The right panel 140 can have a panel body 141 that has a width 141W, a height 141H, and a thickness. The shape (e.g., rectangular, square) of the panel body 141 of the right panel 140 can be substantially the same as the shape and size of the panel body 121 of the left panel 120. In certain example embodiments, the width 141W of the panel body 141 of the right panel 140 is substantially the same as a height 161H of the panel body 161 of the base panel 160, described below. In addition, or in the alternative, the height 141H of the panel body 141 of the right panel 140 can be no greater than the width 161W of the panel body 161 of the base panel 160.

The right panel 140 can also include one or more of a number of coupling features disposed on the panel body 141. For example, as shown in FIG. 1D, disposed along the bottom of the panel body 141 are coupling feature 146, coupling feature 147, coupling feature 148, and coupling feature 149. Coupling feature 146, coupling feature 147, coupling feature 148, and coupling feature 149 are configured to couple to a complementary coupling feature of another component of the basket 110. For example, in this case, coupling feature 146 and coupling feature 147 are configured to couple to coupling feature 164 of the base panel 160, as described below. As another example, in this case, coupling feature 148 and coupling feature 149 are configured to couple to coupling feature 165 of the base panel 160, as described below.

As discussed above, each coupling feature of the right panel 140 can take one of a number of forms. In this case, coupling feature 146 and coupling feature 147 are part of a hinge, and coupling feature 148 and coupling feature 149 are part of another hinge. In certain example embodiments, the coupling features (in this case, coupling feature 146, coupling feature 147, coupling feature 148, and coupling feature 149) disposed along the bottom of the panel body 141 allow the right panel 140 to be movably or removably coupled to the base panel 160. Each of the coupling features (in this case, coupling feature 146, coupling feature 147, coupling feature 148, and coupling feature 149) disposed along the bottom of the panel body 141 of the right panel 140 can be disposed on an inner surface, an outer surface, or extend radially away from the bottom of the panel body 141. In this example, coupling feature 146, coupling feature 147, coupling feature 148, and coupling feature 149 are disposed on the inner surface of the panel body 141.

The right panel 140 can also have one or more other coupling features. For example, as shown in FIG. 1D, disposed along the left side of the panel body 141 is coupling feature 143, and coupling feature 142 can be disposed along the right side of the panel body 141. Coupling feature 142 and coupling feature 143 can be configured to couple to complementary coupling features of another component of the basket 110. For example, in this case, coupling feature 142 is configured to couple to coupling feature 152 and coupling feature 153 of the front panel 150, as described below. As another example, in this case, coupling feature 143 is configured to couple to coupling feature 134 and coupling feature 135 of the rear panel 130, as described below. In this case, coupling feature 142 and coupling feature 143 are each part of a hinge. Each of the coupling features (in this case, coupling feature 142 and coupling feature 143) disposed along a side of the panel body 141 of the right panel 140 can be disposed on an inner surface, an outer surface, or extend radially away from the side of the panel body 141. In this example, coupling feature 142 and coupling feature 143 are disposed on the inner surface of the panel body 141.

The front panel 150 can have a panel body 151 that has a width 151W, a height 151H, and a thickness. The shape (e.g., rectangular, square) and size of the panel body 151 of the front panel 150 can be substantially the same as, or different than, the shape and size of the panel body 121 of the left panel 120 and/or the panel body 141 of the right panel 140. In certain example embodiments, the width 151W of the panel body 151 of the front panel 150 is substantially the same as a width 161W of the panel body 161 of the base panel 160, described below. In addition, or in the alternative, the height 151H of the panel body 151 of the front panel 150 can be no greater than the height 161H of the panel body 161 of the base panel 160.

The front panel 150 can also include one or more of a number of coupling features disposed on the panel body 151. For example, as shown in FIG. 1D, disposed along the bottom of the panel body 151 are coupling feature 156, coupling feature 157, coupling feature 158, and coupling feature 159. Coupling feature 156, coupling feature 157, coupling feature 158, and coupling feature 159 are configured to couple to a complementary coupling feature of another component of the basket 110. For example, in this case, coupling feature 156 and coupling feature 157 are configured to couple to coupling feature 167 of the base panel 160, as described below. As another example, in this case, coupling feature 158 and coupling feature 159 are configured to couple to coupling feature 166 of the base panel 160, as described below.

As discussed above, each coupling feature of the front panel 150 can take one of a number of forms. In this case, coupling feature 156 and coupling feature 157 are part of a hinge, and coupling feature 158 and coupling feature 159 are part of another hinge. In certain example embodiments, the coupling features (in this case, coupling feature 156, coupling feature 157, coupling feature 158, and coupling feature 159) disposed along the bottom of the panel body 151 allow the front panel 150 to be movably or removably coupled to the base panel 160. Each of the coupling features (in this case, coupling feature 156, coupling feature 157, coupling feature 158, and coupling feature 159) disposed along the bottom of the panel body 151 of the front panel 150 can be disposed on an inner surface, an outer surface, or extend radially away from the bottom of the panel body 151. In this example, coupling feature 156, coupling feature 157, coupling feature 158, and coupling feature 159 are disposed on the inner surface of the panel body 151.

The front panel 150 can also have one or more other coupling features. For example, as shown in FIG. 1D, disposed along the left side of the panel body 151 is coupling feature 152 and coupling feature 153, and coupling features 154 and coupling feature 155 can be disposed along the right side of the panel body 151. Coupling feature 152, coupling feature 153, coupling feature 154, and coupling feature 155 can be configured to couple to complementary coupling features of another component of the basket 110. For example, in this case, coupling feature 152 and coupling feature 153 are configured to couple to coupling feature 142 of the right panel 140, as described above. As another example, in this case, coupling feature 154 and coupling feature 155 are configured to couple to coupling feature 123 of the left panel 120, as described below.

In this case, coupling feature 152 and coupling feature 153 are each part of a hinge, and coupling feature 154 and coupling feature 155 are each part of another hinge. Each of the coupling features (in this case, coupling feature 152, coupling feature 153, coupling feature 154, and coupling feature 155) disposed along a side of the panel body 151 of the front panel 150 can be disposed on an inner surface, an outer surface, or extend radially away from the side of the panel body 151. In this example, coupling feature 152, coupling feature 153, coupling feature 154, and coupling feature 155 are disposed on the inner surface of the panel body 151.

The rear panel 130 can have a panel body 131 that has a width 131W, a height 131H, and a thickness. The shape (e.g., rectangular, square) and size of the panel body 131 of the rear panel 130 can be substantially the same as the panel body 151 of the front panel 150. The shape (e.g., rectangular, square) and size of the panel body 131 of the rear panel 130 can be substantially the same as, or different than, the shape and size of the panel body 121 of the left panel 120 and/or the panel body 141 of the right panel 140. In certain example embodiments, the width 131W of the panel body 131 of the rear panel 130 is substantially the same as a width 131W of the panel body 161 of the base panel 160, described below. In addition, or in the alternative, the height 131H of the panel body 131 of the rear panel 130 can be no greater than the height 161H of the panel body 161 of the base panel 160.

In certain example embodiments, the rear panel 130 includes an optional pocket 193 disposed on an inner surface of the panel body 131. The pocket 193 can be used to hold one or more objects separate from objects disposed in the cavity 192 of the basket 110. The rear panel 130 can also include one or more of a number of coupling features disposed on the panel body 131. For example, as shown in FIG. 1D, disposed along the bottom of the panel body 131 are coupling feature 136, coupling feature 137, coupling feature 138, and coupling feature 139. Coupling feature 136, coupling feature 137, coupling feature 138, and coupling feature 139 are configured to couple to a complementary coupling feature of another component of the basket 110. For example, in this case, coupling feature 136 and coupling feature 137 are configured to couple to coupling feature 163 of the base panel 160, as described below. As another example, in this case, coupling feature 138 and coupling feature 139 are configured to couple to coupling feature 162 of the base panel 160, as described below.

As discussed above, each coupling feature of the rear panel 130 can take one of a number of forms. In this case, coupling feature 136 and coupling feature 137 are part of a hinge, and coupling feature 138 and coupling feature 139 are part of another hinge. In certain example embodiments, the coupling features (in this case, coupling feature 136, coupling feature 137, coupling feature 138, and coupling feature 139) disposed along the bottom of the panel body 131 allow the rear panel 130 to be fixedly or removably coupled to the base panel 160. Each of the coupling features (in this case, coupling feature 136, coupling feature 137, coupling feature 138, and coupling feature 139) disposed along the bottom of the panel body 131 of the rear panel 130 can be disposed on an inner surface, an outer surface, or extend radially away from the bottom of the panel body 131. In this example, coupling feature 136, coupling feature 137, coupling feature 138, and coupling feature 139 are disposed on the inner surface of the panel body 131.

The rear panel 130 can also have one or more other coupling features. For example, as shown in FIG. 1D, disposed along the left side of the panel body 131 is coupling feature 132 and coupling feature 133, and coupling features 134 and coupling feature 135 can be disposed along the right side of the panel body 131. Coupling feature 132, coupling feature 133, coupling feature 134, and coupling feature 135 can be configured to couple to complementary coupling features of another component of the basket 110. For example, in this case, coupling feature 132 and coupling feature 133 are configured to couple to coupling feature 122 of the left panel 120, as described above. As another example, in this case, coupling feature 134 and coupling feature 135 are configured to couple to coupling feature 143 of the right panel 140, as described below.

In this case, coupling feature 132 and coupling feature 133 are each part of a hinge, and coupling feature 134 and coupling feature 135 are each part of another hinge. Each of the coupling features (in this case, coupling feature 132, coupling feature 133, coupling feature 134, and coupling feature 135) disposed along a side of the panel body 131 of the rear panel 130 can be disposed on an inner surface, an outer surface, or extend radially away from the side of the panel body 131. In this example, coupling feature 132, coupling feature 133, coupling feature 134, and coupling feature 135 are disposed on the inner surface of the panel body 131.

The base panel 160 can have a panel body 161 that has a width 160W, a height 160H, and a thickness. The shape (e.g., rectangular, square) and size of the panel body 161 of the base panel 160 can be substantially the same as, or different than, the shape and size of the panel body 121 of the left panel 120, the shape and size of the panel body 121 of the rear panel 130, the shape and size of the panel body 141 of the right panel 140, and/or the shape and size of the panel body 151 of the front panel 150. In certain example embodiments, the width 161W of the panel body 161 of the base panel 160 is substantially the same as a width 131W of the panel body 131 of the rear panel 130 and the width 151W of the panel body 151 of the front panel 151. In addition, or in the alternative, the height 161H of the panel body 161 of the base panel 160 can be substantially the same as the width 121W of the panel body 121 of the left panel 120 and the width 141W of the panel body 141 of the right panel 140.

The base panel 160 can also include one or more of a number of coupling features disposed on the panel body 161. For example, as shown in FIG. 1D, disposed along the bottom of the panel body 161 are coupling feature 166 and coupling feature 167. Coupling feature 166 and coupling feature 167 are configured to couple to a complementary coupling feature of another component of the basket 110. For example, in this case, coupling feature 166 is configured to couple to coupling feature 158 and coupling feature 159 of the front panel 150, and coupling feature 167 is configured to couple to coupling feature 156 and coupling feature 157 of the front panel 150.

As another example, as shown in FIG. 1D, disposed along the top of the panel body 161 are coupling feature 162 and coupling feature 162. Coupling feature 162 and coupling feature 163 are configured to couple to a complementary coupling feature of another component of the basket 110. For example, in this case, coupling feature 162 is configured to couple to coupling feature 138 and coupling feature 139 of the rear panel 130, and coupling feature 163 is configured to couple to coupling feature 136 and coupling feature 137 of the rear panel 130.

As yet another example, as shown in FIG. 1D, disposed along the left side of the panel body 161 are coupling feature 168 and coupling feature 169. Coupling feature 168 and coupling feature 169 are configured to couple to a complementary coupling feature of another component of the basket 110. For example, in this case, coupling feature 168 is configured to couple to coupling feature 126 and coupling feature 127 of the left panel 120, and coupling feature 169 is configured to couple to coupling feature 128 and coupling feature 129 of the left panel 120.

As yet another example, as shown in FIG. 1D, disposed along the right side of the panel body 161 are coupling feature 164 and coupling feature 165. Coupling feature 164 and coupling feature 165 are configured to couple to a complementary coupling feature of another component of the basket 110. For example, in this case, coupling feature 164 is configured to couple to coupling feature 146 and coupling feature 147 of the right panel 140, and coupling feature 165 is configured to couple to coupling feature 148 and coupling feature 149 of the right panel 140.

In this case, coupling feature 162, coupling feature 163, coupling feature 164, coupling feature 165, coupling feature 166, coupling feature 167, coupling feature 168, and coupling feature 169 are each part of a hinge. Each of the coupling features (in this case, coupling feature 162, coupling feature 163, coupling feature 164, coupling feature 165, coupling feature 166, coupling feature 167, coupling feature 168, and coupling feature 169) disposed along the top, bottom, or a side of the panel body 161 of the base panel 160 can be disposed on an inner surface, an outer surface, or extend radially away from the top, bottom, and/or side of the panel body 161. In this example, coupling feature 162, coupling feature 163, coupling feature 164, coupling feature 165, coupling feature 166, coupling feature 167, coupling feature 168, and coupling feature 169 are disposed on the inner surface of the panel body 161.

The basket 110 can also include one or more of a number of other components. For example, the basket 110 can include one or more of a number of other coupling features. In this case, the basket 110 of FIGS. 1A-1D include coupling feature 106, coupling feature 107, coupling feature 108, coupling feature 109, coupling feature 111, coupling feature 112, coupling feature 113, coupling feature 114, coupling feature 115, coupling feature 116, coupling feature 117, and coupling feature 118. In this case, coupling feature 106, coupling feature 107, coupling feature 108, coupling feature 109, coupling feature 111, coupling feature 112, coupling feature 113, coupling feature 114, coupling feature 115, coupling feature 116, coupling feature 117, and coupling feature 118 can each be pins that are used in conjunction with other coupling features of one or more other components of the basket 110.

Specifically, coupling feature 106 can be disposed within coupling feature 122 of the left panel 120 and coupling feature 132 and coupling feature 133 of rear panel 130 to couple the left panel 120 and the rear panel 130 to each other. Coupling feature 107 can be disposed within coupling feature 143 of the right panel 130 and coupling feature 134 and coupling feature 135 of rear panel 130 to couple the right panel 140 and the rear panel 130 to each other. Coupling feature 108 can be disposed within coupling feature 142 of the right panel 130 and coupling feature 153 and coupling feature 154 of front panel 150 to couple the right panel 140 and the front panel 150 to each other. Coupling feature 109 can be disposed within coupling feature 123 of the left panel 120 and coupling feature 154 and coupling feature 155 of front panel 150 to couple the left panel 120 and the front panel 150 to each other.

The example basket 110 can have any of a number of side panels. For example, in this case, the basket 110 has four side panels (left panel 120, front panel 150, right panel 140, and rear panel 130). If the basket 110 has more or less than four side panels, the shape of the base panel 160 can vary. For example, if the basket 110 has three side panels, the base panel 160 can have a shape, when viewed from the front, that is triangular. As another example, if the basket 110 has eight sides, the base panel 160 can have a shape, when viewed from the front, that is octagonal.

Figure 2A:
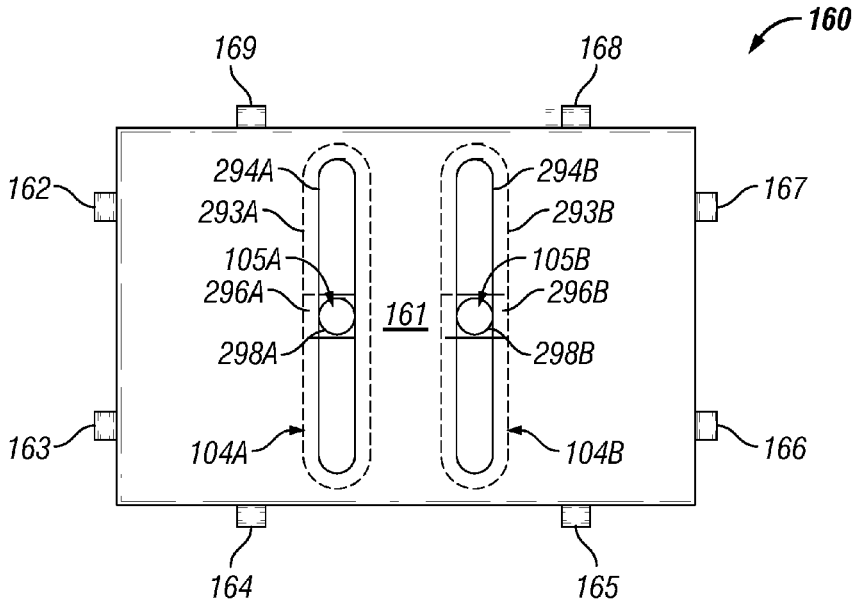
FIGS. 2A and 2B show various views of a base panel of a basket in accordance with certain example embodiments.
Figure 2B:
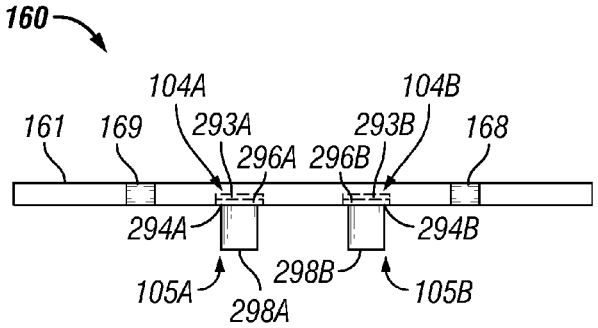
Figure 2C:
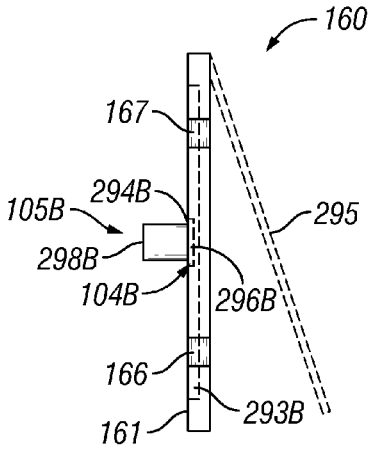

FIGS. 2A and 2B show various views of the base panel 160 of FIGS. 1A-1D in accordance with certain example embodiments. Specifically, FIG. 2A shows a view of the bottom of the base panel 160. FIG. 2B shows a cross-sectional view of the top of the base panel 160. FIG. 2C shows a cross-sectional view of the right side of the base panel 160. Referring to FIGS. 1A-1D, in addition to the features discussed above, the base panel 160 can include one or more of a number of other features. For example, as shown in FIG. 2C, the base panel 160 can include a flap 295 that is movably (e.g., hingedly) to a side (in this case, the top side) of the panel body 161. In this way, when the flap 295 is moved against the panel body 161, the flap can cover some or all of the top surface of the panel body 161.

The flap 295 can have any of a number of shapes and/or sizes. The flap 295 can have a width, a height, and a thickness. In certain example embodiments, the flap 295 can be made of a solid or semi-solid (e.g., plastic) material. In such a case, the flap 295 can be used as a reinforcement of the bottom of the basket 110 when all of the panels of the basket 110 form an open-ended hexahedron, as shown in FIG. 1A. Alternatively, when one or more of the panels (e.g., left panel 120, right panel 140, front panel 150) form are decoupled, at least in part, from their adjacent panels and fold down onto the base panel 160, forming a kind of tray, the flap 295 can lay atop these panels to provide a rigid or semi-rigid surface. In this way, a user can perform one or more functions (e.g., eating, writing, using a laptop computer) using the flap 295.

In alternative embodiments, the flap 295 can be detachably coupled to the base panel 160. In yet another alternative embodiment, the flap 295 is can be a separate piece relative to the base panel 160. Instead of, or in addition to, the base panel 160, the flap 295 can be coupled to one or more other panels of the basket 110. For example, the flap 295 can be coupled to the bottom of the rear panel 130. As another example, the flap 295 can be coupled to the bottom of the front panel 150.

The base panel 160 can also include one or more features that allow the basket 110 to couple to one or more other components (e.g., a mounting assembly 370, discussed below) of a basket assembly. For example, as shown in FIGS. 2A-2C, the base panel 160 can include one or more coupling features 105 disposed along the bottom of the panel body 161 of the base panel 160. In this case, the base panel 160 includes coupling feature 105A and coupling feature 105B.

Each coupling feature 105 can have a bottom feature 296 and a top feature 298. The bottom feature 296 protrudes outward from the coupling feature 104 (in this case, a slotted receiver) and forms cavity. The bottom feature 296, when viewed from the bottom (as in FIG. 2A), can have any of a number of shapes (e.g., circular, oval, square, triangular, octagonal) and sizes. In this case, each bottom feature 296 is circular in shape. The top feature 298 is coupled (e.g., fixedly) to the bottom feature 296. The top feature 298 can be disposed within the coupling feature 104. In such a case, the top feature 298 can have characteristics (e.g., width, shape, size, thickness) that allow the top feature 298 to be disposed within the channel 293 of the coupling feature 104 (described below).

The base panel 160 can also include one or more features that allows the basket 110 to move in one or more directions relative to the coupling features 105 disposed on the bottom of the base panel 160. For example, as shown in FIGS. 2A-2C, the base panel 160 can include one or more coupling features 104 that allow the coupling features 105 to move between the top and the bottom of the base panel 160. Specifically, in this case, coupling feature 105A is slidably disposed within coupling feature 104A, and coupling feature 105B is slidably disposed within coupling feature 104B.

Each coupling feature 104 (in this case, coupling feature 104A and coupling feature 104B) can include an opening 294 at the bottom of the coupling feature 104, where the opening 294 traverses some or all of the length of the coupling feature 104. Further, the opening 294 can have a width that is substantially the same as, or slightly larger than, the width of the top feature 298 of the coupling feature 105 that is disposed therein. The opening 294 can have one or more of a number of features (e.g., detents) that allow the bottom feature 296 of a coupling feature 105 to move between discrete positions along the coupling feature 104. Alternatively, the coupling feature 105 may include one or more features (e.g., a lock screw, a clamp) that allow the coupling feature 105 to freely move within the coupling feature 104 when disengaged and secure the coupling feature 105 in a position relative to the coupling feature 104 when engaged.

Each coupling feature 104 can also include a channel 293 at the top of the coupling feature 104, where the channel 293 defines the length of the coupling feature 104. Further, the channel 293 can have a width that is substantially the same as, or slightly larger than, the width of the top feature 298 of the coupling feature 105 that is disposed therein. The channel 293 can have one or more of a number of features (e.g., detents) that allow the top feature 298 of a coupling feature 105 to move between discrete positions along the coupling feature 104.

Each coupling feature 104 can be a separate component of the basket 110 that is disposed on the bottom outer surface of the panel body 161 of the base panel 160. In such a case, the channel 293 can be disposed outside the panel body 161 of the base panel 160. Alternatively, each coupling feature 104 can be integrated with and disposed within the panel body 161 of the base panel 160. In such a case, the channel 293 can be disposed within the panel body 161 of the base panel 160.

Figure 3A:
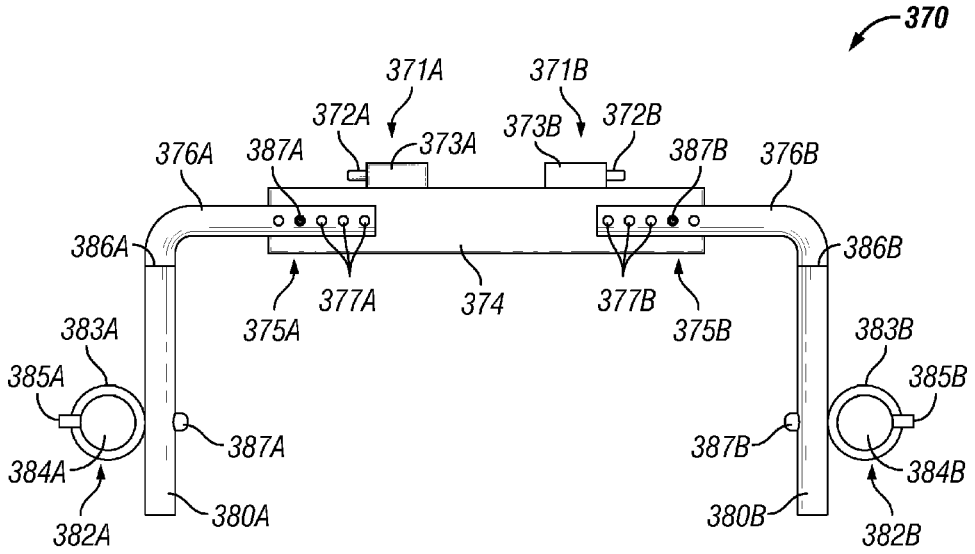
FIGS. 3A and 3B show a mounting assembly in accordance with certain example embodiments.
Figure 3B:
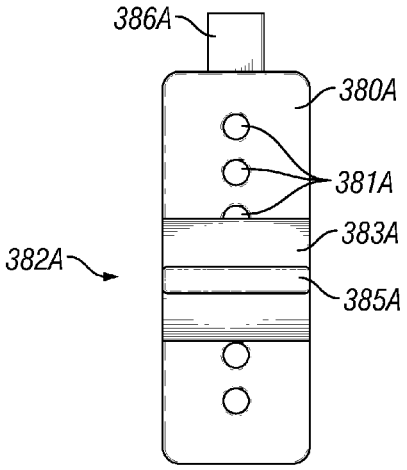

FIGS. 3A and 3B show a mounting assembly 370 in accordance with certain example embodiments. FIG. 3A shows a front view of the mounting assembly 370, and FIG. 3B shows a side view of an extension member 380 of the mounting assembly 370. Referring to FIGS. 1A-3B, the mounting assembly 370 is designed to couple to a basket (e.g., basket 110) and to a wheelchair. The mounting assembly 370 can be adjustable in terms of its width and height. Further, the mounting assembly 370 can be removably coupled to one portion of a wheelchair while remaining coupled to another portion of the wheelchair, allowing a user to move the mounting assembly 370 (as well as the basket 110) from the area where the user's lap is to a location off to the side of the wheelchair, out of the way of the user.

In certain example embodiments, the mounting assembly 370 include one or more portions. For example, as shown in FIGS. 3A and 3B, the mounting assembly 370 can include one or more (in this case, two) extension members 380, one or more (in this case, two) wheelchair coupling features 382, one or more (in this case, two) transition members 376 (also referred to herein as elbows), and a stabilizer bar 374 (also referred to herein as a main portion of the mounting assembly). The stabilizer bar 374 is a substantially elongated member that is coupled to one transition member 376A at one end 375A and another transition member 376B at the other end 375B.

Each end of the stabilizer bar 374 can include one or more coupling features (e.g., one or more apertures, one or more slots), hidden from view in FIG. 3A by transition member 376 and coupling feature 387, that couple to one or more complementary coupling features of a transition member 376. For example, in this case, one end 375A of the stabilizer bar 374 has a coupling feature in the form of a slot (hidden from view) in which an end of the transition member 376A slidably couples, and another coupling feature in the form of an aperture (hidden from view by coupling feature 387A) that indirectly couples to one of a number of complementary coupling features (in this case, apertures 377A) that traverse the end of the transition member 376A.

Also, the other end 375B of the stabilizer bar 374 has a coupling feature in the form of slot (hidden from view) in which an end of the transition member 376B slidably couples, and another coupling feature in the form of an aperture (hidden from view by coupling feature 387B) that indirectly couples to one of a number of complementary coupling features (in this case, apertures 377B) that traverse the end of the transition member 376B. As an alternative embodiment to what is shown in FIG. 3A, end 375A and end 375B of the stabilizer bar 374 can have a number of coupling features (in this case, apertures) that traverse that end within the slot of that end, while each transition member 376 has a single aperture 377 that traverses therethrough.

When the coupling feature 387A is removed by a user, the slot of the stabilizer bar 374 remains coupled to the transition member 376A, but the transition member 376A can slide within the slot of the stabilizer bar 374. This allows the width of the basket assembly 370 to change. As yet another alternative embodiment to what is shown in FIG. 3A, end 375A and end 375B of the stabilizer bar 374 can have no slots, but have a number of coupling features (in this case, apertures) that traverse that end, while each transition member 376 has the number of coupling features 377, such as the apertures shown in FIG. 3A, that traverses therethrough. Coupling feature 387A can be a pin, a screw, a bolt, or some similar device that is removably disposed within one of coupling feature 377A of the transition member 376A as well as a coupling feature (also an aperture) that traverses some or all of the end 375A of the stabilizer bar 374. Even without the slot in an end 375 of the stabilizer bar 374, the width of the basket assembly 370 can be adjusted.

Also, while FIG. 3A shows that there is a transition member 376 coupled to each end 375 of the stabilizer bar 374, alternative embodiments can have only one transition member (e.g., transition member 376B) coupled to one end (e.g., end 375A) of the stabilizer bar 374, while there is no transition member coupled to the other end (e.g., end 375A) of the stabilizer bar 374. In this case, the end 375 of the stabilizer bar 374 that is not coupled to a transition member 376 can have one or more of the coupling features described above, or can be without any such coupling features.

The stabilizer bar 374 can also include one or more of a number of coupling features that allow the stabilizer bar 374 to couple to a basket (e.g., basket 110). For example, as shown in FIG. 3A, the stabilizer bar 374 can include one or more coupling features (in this case, coupling feature 371A and coupling feature 371B) that are configured to couple to the basket 110. Coupling feature 371A and coupling feature 371B can be substantially the same as, or different than, each other. In this case, coupling feature 371A includes a cylinder 373A and a locking feature 372A. Similarly, since coupling feature 371B is substantially the same as coupling feature 371A in this example, coupling feature 371B includes a cylinder 373B and a locking feature 372B.

The cylinder 373 of each coupling feature 371 can have a shape and size that allows a complementary coupling feature (in this case, coupling feature 105) of the basket 110 to couple with the coupling feature 371. Thus, if a coupling feature 105 of the basket is circular in shape when viewed from the bottom, then the coupling feature 371 (or, more specifically, the cylinder 373 of the coupling feature 371) can be circular in shape when viewed from above. Further, the diameter of the coupling feature 371 can be slightly larger than the diameter of the coupling feature 105 so that the coupling feature 105 can be slidably disposed within the coupling feature 371. Alternatively, the diameter of the coupling feature 371 can be slightly smaller than the diameter of the coupling feature 105 so that the coupling feature 371 can be slidably disposed within the coupling feature 105. In such a case, the coupling feature 371 has no locking feature 372, but a similar locking feature can be part of the coupling feature 105.

In certain example embodiments, the locking feature 372 can be any type of feature (e.g., a pin, a bolt, a screw, a latch) that has an engaged state and a disengaged state. When in the engaged state, the locking feature 372 engages both the cylinder 373 of the coupling feature 371 and the coupling feature 105 of the basket 110. This allows the basket 110 to be secured relative to the mounting assembly 370. When in the disengaged state, the locking feature 372 is no longer engaged with the coupling feature 105 of the basket 110. This allows the basket 110 to be decoupled from the mounting assembly 370. When the stabilizer bar 374 includes one or more coupling features 371 for coupling the mounting assembly 370 with the basket 110, the coupling features 371 can be positioned (e.g., from manufacturing, movable by a user) so that the coupling features 371 are aligned with the coupling features 105 of the basket 110.

In certain example embodiments, each extension member 380 is coupled to a transition member 376. In this case, extension member 380A is coupled to transition member 376A, and extension member 380B is coupled to transition member 376B. Thus, one end of a transition member 376 is coupled to the stabilizer bar 374, while the other end of the transition member 376 is coupled to an extension member 380. In certain example embodiments, each transition member 376 has a curvature (e.g., a bend of approximately 90°) to orient the stabilizer bar 374 substantially perpendicular to each extension member 380.

An extension member 380 can be rotatably coupled to a transition member 376 at the top end 386 of the extension member 380. In some cases, an extension member 380 and a transition member 376 can be the same piece, where the top piece (represented by transition member 376) is rotatably coupled to the bottom piece (represented by extension member 380) at junction 386. Aside from coupling features (e.g., mating threads, detents, protrusion) that allow an extension member 380 to couple to a transition member 376, each extension member 380 can include one or more of a number of coupling features that allow the extension member 380 to couple, directly or indirectly, to a wheelchair.

For example, as shown in FIG. 3B, extension member 380A has a number of coupling features 381A disposed along a portion of the length of the extension member 380A. In this case, the coupling features 381A are apertures that traverse the extension member 380A. Similarly, extension member 380B has a number of coupling features 381B disposed along a portion of the length of the extension member 380B. In this case, the coupling features 381B are apertures that traverse the extension member 380B.

In certain example embodiments, one or more additional coupling features are coupled to one or more coupling features 381 of an extension member 380. For example, as shown in FIGS. 3A and 3B, one or more wheelchair coupling features 382 can be coupled to the coupling features 381 of an extension member 380. In this case, each coupling feature 382 can be a type of clamp. As shown in FIG. 3A, coupling feature 382A is coupled to one of the coupling features 381A if extension member 380A, and coupling feature 382B is coupled to one of the coupling features 381B if extension member 380B.

In certain example embodiments, each coupling feature 382 includes one or more of a number of components. For example, in this case, coupling feature 382A can include a pin 387A, a body 383A that forms a cavity 384A, and an opening mechanism 385A. Similarly, coupling feature 382B can include a pin 387B, a body 383B that forms a cavity 384B, and an opening mechanism 385B. The pin 387 of a coupling feature 382 can be any type of device (e.g., a pin, a bolt, a spring) that couples to one or more of the coupling features 381 of an extension member 380. Further, the pin 387 can be removed by a user, so that the pin can be moved from one coupling feature 381 of an extension member 380 to another coupling feature 381 of the extension member 380. In this way, the coupling feature 382 that includes the pin 387 can be moved vertically relative to the extension member 380. As a result, the height of the mounting assembly 370 can be adjusted relative to the wheelchair.

The body 383, in conjunction with the opening mechanism 385, of a coupling feature 382 can be configured to couple to, and subsequently be decoupled from, a portion of a wheelchair. For example, the body 383 of a coupling feature 382 can be disposed around a frame of the wheelchair. Thus, the shape and size of the body 383 can be configured to substantially match the shape and size of the portion of the frame of the wheelchair to which the coupling feature 382 couples. The opening mechanism 385 can facilitate opening and/or closing the body 383 around the wheelchair. The opening mechanism 385 can be coupled to the body 383 in one or more of any number of ways, including but not limited to slidably, rotatably, and removably. The opening mechanism 385 can be a clip, a latch, a slide, a clamp, or any other suitable mechanism.

Figure 4:
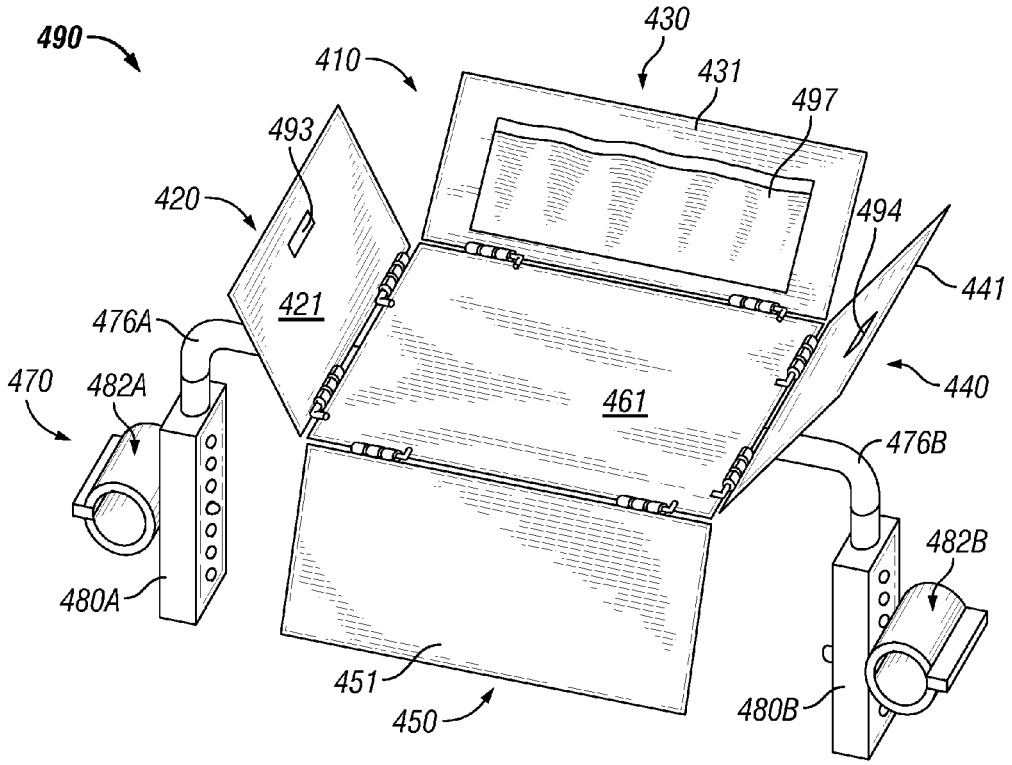
FIG. 4 shows a basket assembly in accordance with certain example embodiments.

FIG. 4 shows a basket assembly 490 in accordance with certain example embodiments. The basket assembly 490 can include a combination of a basket 410 and a mounting assembly 470. The basket 410 of FIG. 4 can be substantially similar to the basket 110 of FIGS. 1A-2C, and the mounting assembly 470 of FIG. 4 can be substantially similar to the mounting assembly 370 of FIGS. 3A and 3B, except as described below.

Referring to FIGS. 1A-4, The various panels of the basket 410 aside from the base panel 460 are not coupled along their sides. In other words, the panel body 431 of the rear panel 430 is not coupled to the panel body 421 of the left panel 420 or the panel body 441 of the right panel 440, the panel body 421 of the left panel 420 is not coupled to the panel body 431 of the rear panel 430 or the panel body 451 of the front panel 450, the panel body 451 of the front panel 450 is not coupled to the panel body 421 of the left panel 420 or the panel body 441 of the right panel 440, and the panel body 441 of the right panel 440 is not coupled to the panel body 431 of the rear panel 430 or the panel body 451 of the front panel 450.

Thus, the left panel 420, the rear panel 430, the right panel 440, and/or the front panel 450 can each move freely (e.g., rotate) relative to the base panel 460. While the details are hidden from view by the panel body 451 of the front panel 450, the coupling features 405 disposed on the bottom surface of the panel body 461 of the base panel 460 are coupled to the coupling features 471 of the stabilizer bar 474, which allows the basket 410 and the mounting assembly 470 to be coupled to each other.

Further, there is an aperture 493 that traverses the panel body 421 of the left panel 420. The aperture 493 in this case is disposed near the top end of the panel body 421. In this way, the aperture 493 can serve as a handle. Similarly, there is an aperture 494 that traverses the panel body 441 of the right panel 440. The aperture 494 in this case is disposed near the top end of the panel body 441. In this way, the aperture 494 can serve as a handle. Since aperture 494 and aperture 493 are disposed on opposite sides of the basket 410 when each of the panels is coupled to their adjacent panels, aperture 494 and aperture 493 provide a user a convenient way to carry the basket 410.

Figure 5:
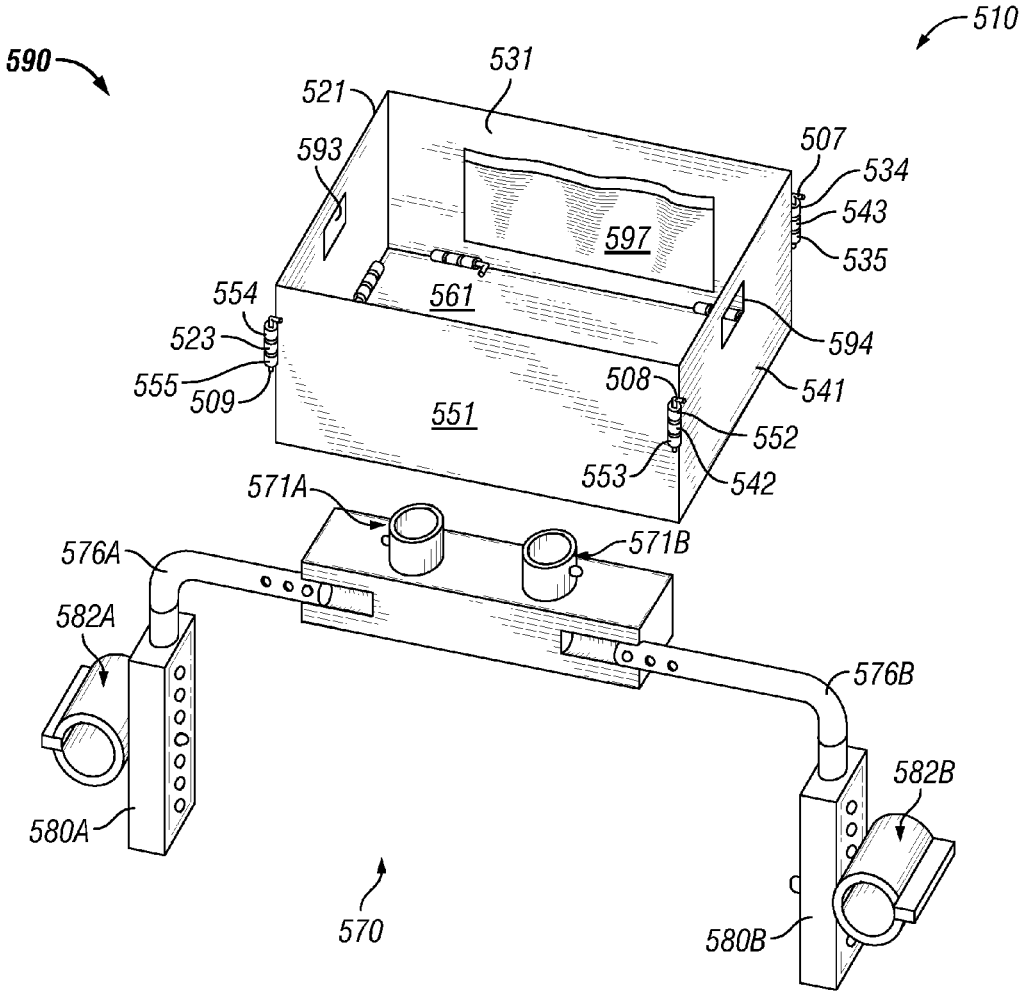
FIG. 5 shows another basket assembly in accordance with certain example embodiments.

FIG. 5 shows another basket assembly 590 in accordance with certain example embodiments. The basket assembly 590 can include a combination of a basket 510 and a mounting assembly 570. The basket 510 of FIG. 5 can be substantially similar to the basket 110 of FIGS. 1A-2C and the basket 410 of FIG. 4, and the mounting assembly 570 of FIG. 5 can be substantially similar to the mounting assembly 370 of FIGS. 3A and 3B and the mounting assembly 470 of FIG. 4, except as described below.

Referring to FIGS. 1A-5, each of the panels is coupled to their adjacent panels, forming a basket 510. Further, FIG. 5 shows how the coupling features 505 disposed on the bottom surface of the panel body 561 of the base panel 560 are coupled to the coupling features 571 of the stabilizer bar 574, which allows the basket 510 and the mounting assembly 570 to be coupled to each other.

Figure 6A:
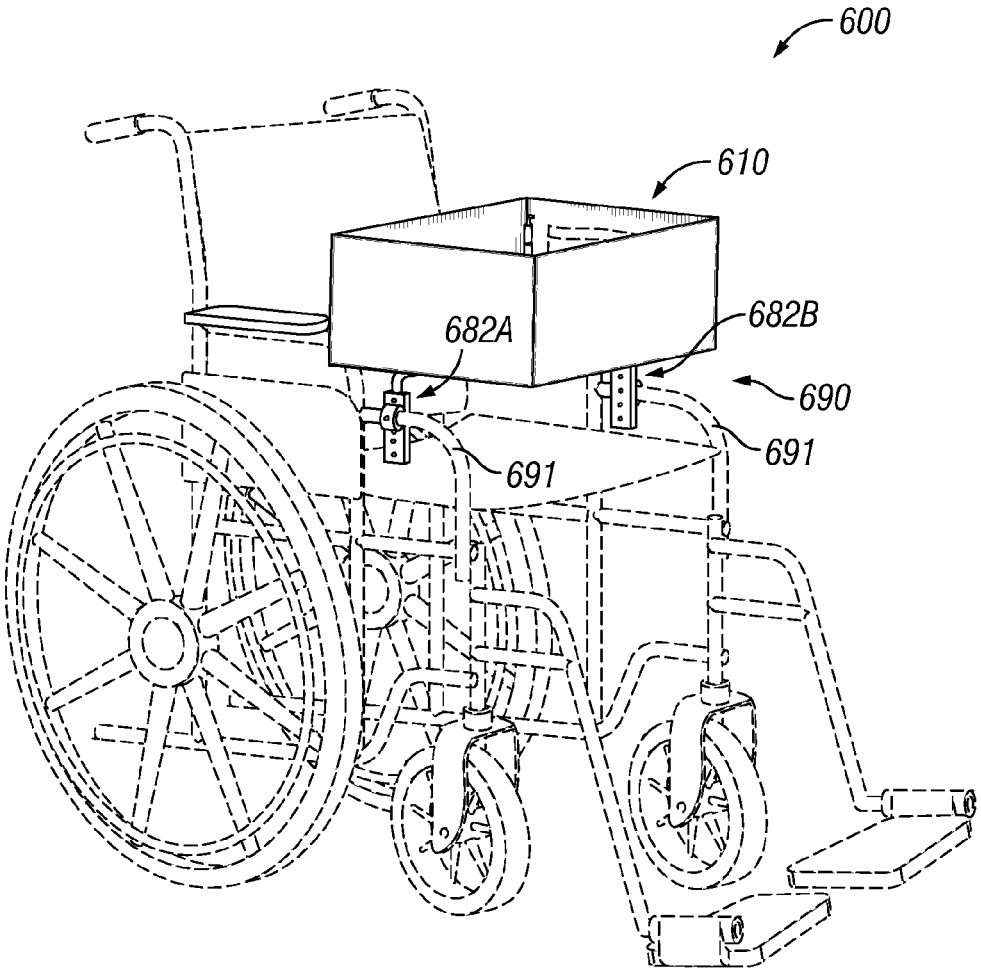
FIGS. 6A and 6B show a wheelchair with a basket assembly in accordance with certain example embodiments.
Figure 6B:
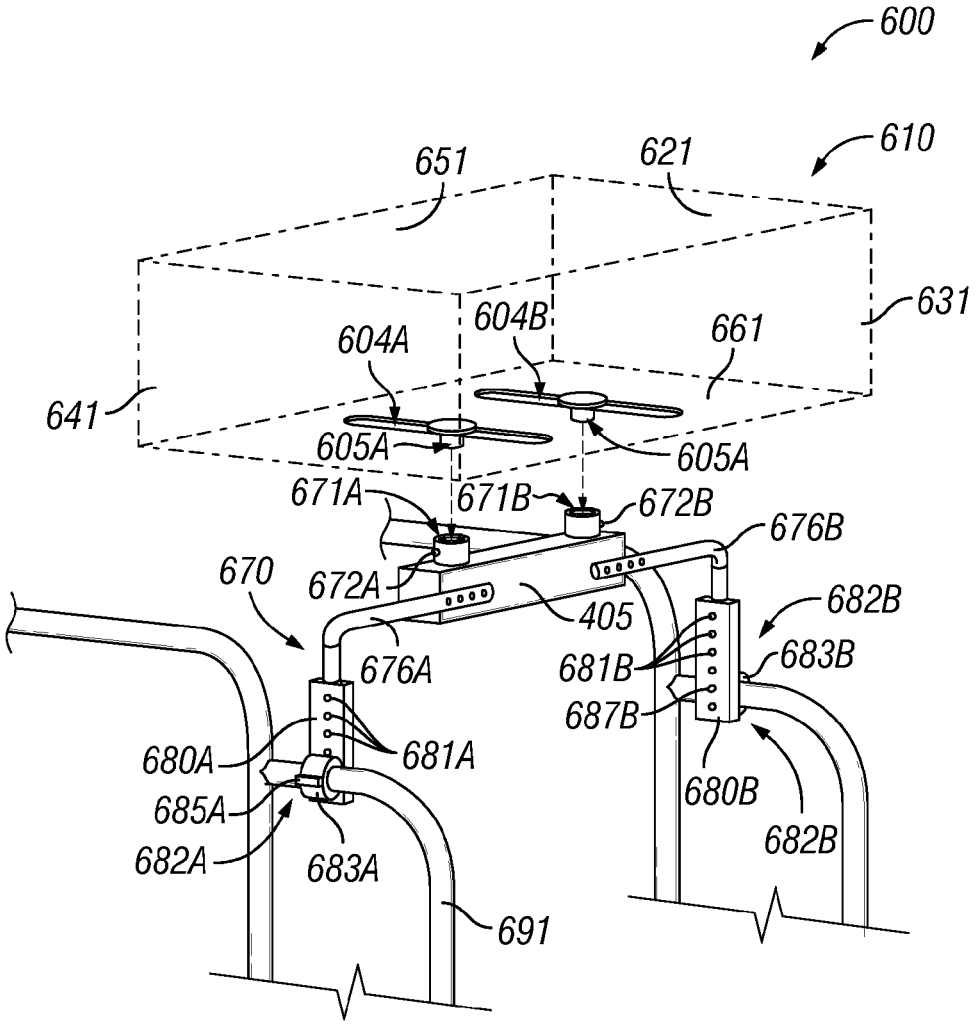

FIGS. 6A and 6B show a wheelchair 600 with a basket assembly 690 in accordance with certain example embodiments. The basket assembly 690 of FIGS. 6A and 6B can be substantially similar to the basket assemblies described above. Referring to FIGS. 1A-6B, the wheelchair 600 has a frame 691 to which the coupling features 682 of the mounting assembly 670 couple. In this case, the portion of the frame 691 to which the coupling features 682 of the mounting assembly 670 couple is adjacent to each of the arm rests of the wheelchair 600. The frame 691 in this case is substantially tubular. In this case, one coupling feature 682A of the mounting assembly 670 is coupled to the frame 691 on one side of the wheelchair 600, and another coupling feature 682B of the mounting assembly 670 is coupled to the frame 691 on the other side of the wheelchair 600.

The height of the basket assembly 690 can be adjusted by changing the coupling feature 681 of the extension member 680 to which each coupling feature 682 is coupled. Further, the closeness of the basket 610 to the user in the wheelchair 600 can be changed by adjusting the coupling features 605 disposed on the bottom surface of the panel body 661 of the base panel 660 relative to the coupling features 604.

Figure 7:
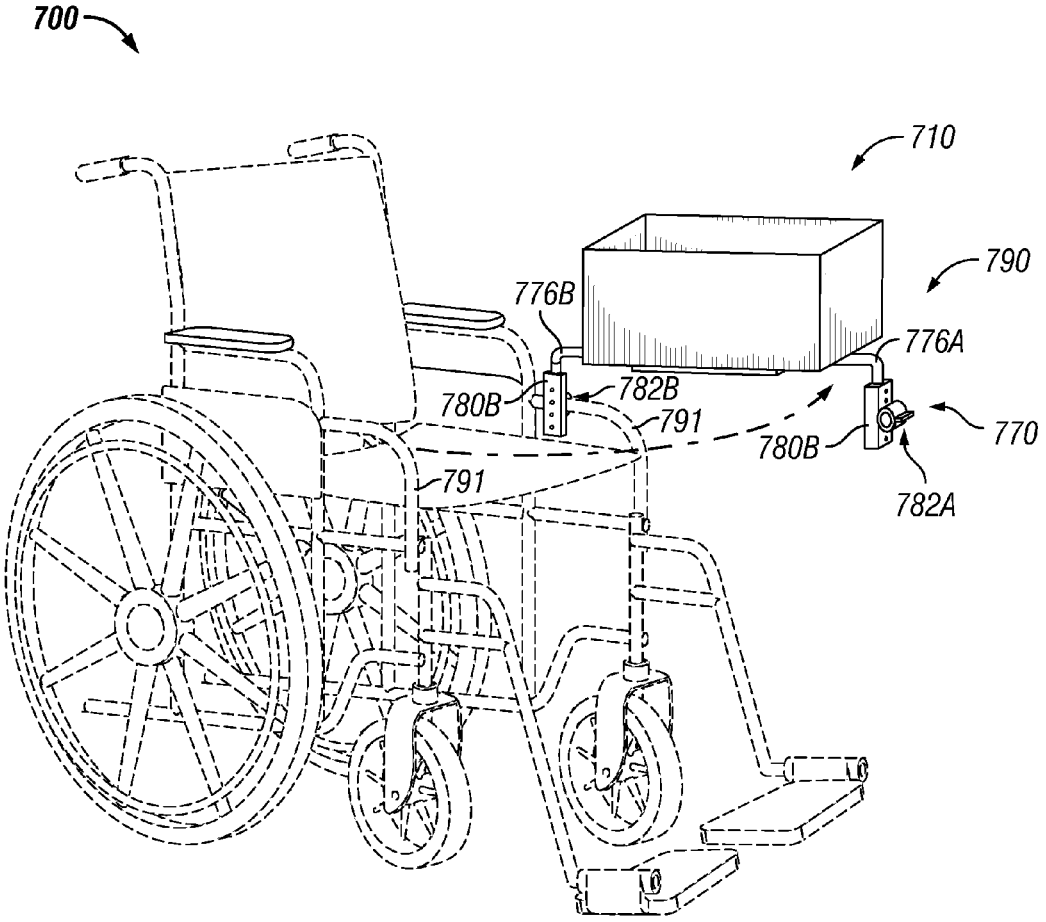
FIG. 7 shows another wheelchair with a basket assembly in accordance with certain example embodiments.

FIG. 7 shows the wheelchair 700 with the basket assembly 790 in accordance with certain example embodiments. The wheelchair 700 of FIG. 7 can be substantially similar to the wheelchair 600 of FIGS. 6A and 6B. Further, the basket assembly 790 of FIG. 7 can be substantially the same as the basket assemblies described herein. In this case, the basket assembly 790 has been moved to one side of the wheelchair 700 while remaining coupled to the frame 791 of the wheelchair 700. To accomplish this, coupling feature 782A is decoupled from the frame 791 of the wheelchair 700 while coupling feature 782B remains coupled to the frame 791 of the wheelchair 700.

Once coupling feature 782A is decoupled from the frame 791 of the wheelchair 700, a user can push the basket assembly 790 to one side (in this case, the left side). When this occurs, the coupling feature 782B and the extension member 780B to which the coupling feature 782B is coupled remain in a fixed position relative to the frame 791 of the wheelchair 700, while the rest of the basket assembly 790 rotates about the top end 786 or junction 786 of the extension member 780. In this way, a user can get up from the wheelchair 700 without completely decoupling or removing the basket assembly 790 from the wheelchair 700.

Example embodiments provide for functional basket assemblies for a wheelchair. Specifically, certain example embodiments allow for a basket assembly that is coupled to one or more portions of a wheelchair. Example embodiments can be adjusted in height (vertical displacement) and/or distance (horizontal displacement) relative to a user in the wheelchair. Example embodiments can comply with applicable standards and/or regulations (e.g., ADA). In some cases, example embodiments can remain coupled to a wheelchair while being moved to one side so that access to a user in the wheelchair and/or to place a user in the wheelchair can be achieved without completely decoupling or removing the example basket assembly from the wheelchair. The example basket can be easily reconfigured into one or more of a number of functional modes, including but not limited to a basket, a tray, a working platform (e.g., a desk), and privacy station (as when only the rear panel and/or the side panels remains substantially perpendicular to the base panel.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A basket assembly for a wheelchair, the basket assembly comprising:

a basket comprising:

a base panel comprising at least one bracket coupling feature, wherein the at least one bracket coupling feature comprises a top feature and a bottom feature, wherein the top feature is disposed within the base panel, wherein the bottom feature extends through an opening in the base panel;

a rear panel coupled to the base panel;

a front panel coupled to the base panel;

a left side panel coupled to the base panel, the rear panel, and the front panel; and a right side panel coupled to the base panel, the rear panel, and the front panel; and a mounting assembly coupled to the basket, wherein the mounting assembly comprises:

a main portion comprising a first end, a second end, and at least one basket coupling feature disposed between the first end and the second end, wherein the at least one basket coupling feature comprises a cylinder and a locking feature, wherein the cylinder extends upward from the main portion and couples to the bottom feature of the at least one bracket coupling feature of the basket, wherein the locking feature extends laterally from a side of the cylinder, and wherein the locking feature engages the at least one bracket coupling feature of the basket;

an elbow coupled to the first end of the main portion; and a wheelchair coupling feature coupled to the elbow, wherein the wheelchair coupling feature is configured to couple to a portion of a wheelchair.

2. The basket assembly of claim 1, wherein the left side panel comprises a first front panel coupling feature and a first rear panel coupling feature, wherein the right side panel comprises a second front panel coupling feature and a second rear panel coupling feature, wherein the rear panel comprises a first left side panel coupling feature and a first right side panel coupling feature, wherein the front panel comprises a second left side panel coupling feature and a second right side panel coupling feature, wherein the first front panel coupling feature couples to the second left side panel coupling feature, wherein the first rear panel coupling feature couples to the first left side panel coupling feature, wherein the second front panel coupling feature couples to the second right side panel coupling feature, and wherein the second rear panel coupling feature couples to the first right side panel coupling feature.

3. The basket assembly of claim 2, wherein the basket further comprises a first plurality of pins, wherein the first front panel coupling feature and the second left side panel coupling feature are coupled using a first pin of the first plurality of pins, wherein the first rear panel coupling feature and the first left side panel coupling feature are coupled using a second pin of the first plurality of pins, wherein the second front panel coupling feature and the second right side panel coupling feature are coupled using a third pin of the first plurality of pins, and wherein the second rear panel coupling feature and the first right side panel coupling feature are coupled using a fourth pin of the first plurality of pins.

4. The basket assembly of claim 3, wherein the first plurality of pins are removable by a user.

5. The basket assembly of claim 4, wherein the rear panel is fixedly coupled to the base panel.

6. The basket assembly of claim 3, wherein the front panel, the left side panel, and the right side panel are movably coupled relative to the base panel.

7. The basket assembly of claim 6, wherein the left side panel comprises a first base panel coupling feature, wherein the right side panel comprises a second base panel coupling feature, wherein the rear panel comprises a third base panel coupling feature, wherein the front panel comprises a fourth base panel coupling feature, wherein the base panel comprises a left side panel coupling feature, a right side panel coupling feature, a front panel coupling feature, and a rear panel coupling feature, wherein the first base panel coupling feature couples to the left side panel coupling feature, wherein the second base panel coupling feature couples to the right side panel coupling feature, wherein the third base panel coupling feature couples to the rear panel coupling feature, and wherein the fourth base panel coupling feature couples to the front panel coupling feature.

8. The basket assembly of claim 1, wherein the left side panel and the right side panel each have a side panel width and a side panel height, wherein the side panel width is substantially the same as a base panel height of the base panel, and wherein the side panel height is no greater than a base panel width.

9. The basket assembly of claim 1, wherein the front panel and the rear panel each have a width and a height, wherein the width is substantially the same as a base panel width of the base panel, and wherein the height is no greater than a base panel height of the base panel.

10. The basket assembly of claim 1, wherein the basket is slidably coupled to the mounting assembly by moving the at least one bracket coupling feature relative to the base panel.

11. The basket assembly of claim 10, wherein the at least one basket coupling feature comprises a slotted receiver disposed on a bottom surface of the base panel between a front edge of the base panel and a rear edge of the base panel, wherein the top feature of the at least one bracket coupling feature is disposed within a channel of the slotted receiver, and wherein the bottom feature of the at least one bracket coupling feature extends through an opening in the slotted receiver.

12. A mounting assembly for a wheelchair, the mounting assembly comprising:

a main portion comprising a first end, a second end, and at least one basket coupling feature disposed between the first end and the second end, wherein the at least one basket coupling feature comprises a cylinder that extends upward from the main portion, wherein the cylinder is configured to couple to at least one mounting assembly coupling feature of a basket;

a first elbow coupled to the first end of the main portion; and a first wheelchair coupling feature coupled to the first elbow, wherein the first wheelchair coupling feature is configured to couple to the wheelchair, and wherein the at least one basket coupling feature further comprises a locking feature that extends laterally from a side of the cylinder, wherein the locking feature is configured to engage the at least one mounting assembly coupling feature of the basket.

13. The mounting assembly of claim 12, the first wheelchair coupling feature comprises a clamp, wherein the clamp is configured to couple to a portion of a frame of the wheelchair, wherein the portion of the frame is adjacent to an armrest of the wheelchair.

14. The mounting assembly of claim 12, wherein the first elbow is movably coupled to the first end of the main portion, wherein adjusting the first elbow relative to the first end of the main portion adjusts a width of the mounting assembly.

15. The mounting assembly of claim 12, wherein the first wheelchair coupling feature is movably coupled to the first elbow, wherein adjusting the first wheelchair coupling feature relative to the first elbow adjusts a height of the mounting assembly.

16. The mounting assembly of claim 12, further comprising:

a second elbow coupled to the second end of the main portion; and a second wheelchair coupling feature coupled to the second elbow, wherein the second wheelchair coupling feature is configured to couple to the wheelchair, and wherein the main portion rotates relative to the second wheelchair coupling feature using the second elbow.

17. The mounting assembly of claim 12, wherein the second elbow is movably coupled to the second end of the main portion.

18. The mounting assembly of claim 12, wherein the second wheelchair coupling feature is movably coupled to the second elbow.

19. A wheelchair, comprising:

a frame; and a basket assembly coupled to the frame, wherein the basket assembly comprises:

a basket comprising:

a base panel comprising at least one bracket coupling feature, wherein the at least one bracket coupling feature comprises a top feature and a bottom feature, wherein the top feature is disposed within the base panel, wherein the bottom feature extends through an opening in the base panel;

a rear panel coupled to the base panel;

a front panel coupled to the base panel;

a left side panel coupled to the base panel, the rear panel, and the front panel; and a right side panel coupled to the base panel, the rear panel, and the front panel; and a mounting assembly coupled to the basket, wherein the mounting assembly comprises:

a main portion comprising a first end, a second end, and at least one basket coupling feature disposed between the first end and the second end, wherein the at least one basket coupling feature comprises a cylinder and a locking feature, wherein the cylinder extends upward from the main portion and couples to the bottom feature of the at least one bracket coupling feature of the basket, wherein the locking feature extends laterally from a side of the cylinder, and wherein the locking feature engages the at least one bracket coupling feature of the basket;

an elbow coupled to the first end of the main portion; and a wheelchair coupling feature coupled to the elbow and to the frame of the wheelchair.

20. The wheelchair of claim 19, wherein the wheelchair coupling feature is coupled to a frame portion of the wheelchair, wherein the frame portion is adjacent to an armrest of the wheelchair.

* * * * *